US011542794B2

(12) United States Patent
Tønnessen et al.

(10) Patent No.: US 11,542,794 B2
(45) Date of Patent: Jan. 3, 2023

(54) SUBSEA COMPRESSION SYSTEM AND METHOD

(71) Applicant: FMC Kongsberg Subsea AS, Kongsberg (NO)

(72) Inventors: Leif Arne Tønnessen, Bærums Verk (NO); Jan Helge Hassel, Røyken (NO); Paolo Romanello, Asker (NO)

( * ) Notice: Subject to any disclaimer, the term of this patent is extended or adjusted under 35 U.S.C. 154(b) by 128 days.

(21) Appl. No.: 17/254,743

(22) PCT Filed: Jun. 24, 2019

(86) PCT No.: PCT/EP2019/066643
§ 371 (c)(1),
(2) Date: Dec. 21, 2020

(87) PCT Pub. No.: WO2020/002215
PCT Pub. Date: Jan. 2, 2020

(65) Prior Publication Data

US 2021/0270110 A1 Sep. 2, 2021

(30) Foreign Application Priority Data

Jun. 25, 2018 (NO) ..... 20180897

(51) Int. Cl.
*E21B 43/36* (2006.01)
*E21B 43/01* (2006.01)
(Continued)

(52) U.S. Cl.
CPC ..... *E21B 43/12* (2013.01); *E21B 34/06* (2013.01); *E21B 43/01* (2013.01)

(58) Field of Classification Search
CPC ..... E21B 41/0007; E21B 43/01; E21B 43/36
See application file for complete search history.

(56) References Cited

U.S. PATENT DOCUMENTS 7,819,950 B2 10/2010 Stinessen et al.
9,303,488 B2 4/2016 Kanstad
(Continued)

FOREIGN PATENT DOCUMENTS

GB 2503927 A 1/2014
WO WO 2010/144187 A1 12/2010

*Primary Examiner* — Kenneth L Thompson

(57) ABSTRACT

A subsea hydrocarbon flow compression system (100) for receiving a hydrocarbon stream from at least one upstream flowline (102, 104) and supplying the hydrocarbon stream to at least one downstream flowline (106, 108) at an increased pressure, wherein the compression system comprises first and second compressor trains (110*a*, 110*b*), wherein each compressor train comprises an inlet port (112*a*, 112*b*) which is connectable to the at least one upstream flowline (102, 104); an outlet port (114*a*, 114*b*) which is connectable to the at least one downstream flowline (106, 108); a conditioning unit (116*a*, 116*b*) which is connected to the inlet port via a first flowline (118*a*, 118*b*); and a first flow path for the hydrocarbon fluid comprising a compressor (120*a*, 120*b*), which compressor is connected to the conditioning unit via a second flowline (122*a*, 122*b*) and to the outlet port via a third flowline (124*a*, 124*b*), wherein a controllable first valve (126) is arranged in the third flowline of the first compressor train for controlling hydrocarbon flow from the compressor to the outlet port of the first compressor train. A controllable second valve (128) is arranged in the second flowline of the second compressor train for controlling hydrocarbon flow from the conditioning unit to the compressor of the second compressor train. The system further comprises a first cross-over flowline (130) interconnecting the third flowline of the first compressor train upstream of the first valve and the second flowline of the second compressor train downstream of the second valve, wherein a controllable first cross-over valve (132) is arranged in the
(Continued)

first cross-over flowline for controlling hydrocarbon flow through the first cross-over flowline.

15 Claims, 2 Drawing Sheets

(51) Int. Cl.
*E21B 43/12* (2006.01)
*E21B 34/06* (2006.01)

(56) References Cited

U.S. PATENT DOCUMENTS

| | | | | |
|---|---|---|---|---|
| 9,377,164 | B2 * | 6/2016 | Utal | F17C 13/123 |
| 10,561,977 | B2 * | 2/2020 | Johannessen | B01D 53/1493 |
| 10,619,462 | B2 * | 4/2020 | Elmer | E21B 43/38 |
| 11,339,639 | B2 * | 5/2022 | Johnsen | E21B 43/36 |
| 2012/0118008 | A1 | 5/2012 | Dam et al. | |
| 2014/0003963 | A1 | 1/2014 | Wessel | |
| 2017/0159421 | A1 | 6/2017 | Sillapacharn et al. | |

* cited by examiner

SUBSEA COMPRESSION SYSTEM AND METHOD

FIELD OF THE INVENTION

The present invention relates to a subsea hydrocarbon compression system.

In particular, the present invention relates to a subsea hydrocarbon flow compression system for receiving a hydrocarbon stream from at least one upstream flowline and supplying the hydrocarbon stream to at least one downstream flowline at an increased pressure, wherein the compression system comprises first and second compressor trains, wherein each compressor train comprises:

- an inlet port which is connectable to the at least one upstream flowline;
- an outlet port which is connectable to the at least one downstream flowline;
- a conditioning unit which is connected to the inlet port via a first flowline; and
- a first flow path for the hydrocarbon fluid comprising a compressor, which compressor is connected to the conditioning unit via a second flowline and to the outlet port via a third flowline, wherein a controllable first valve is arranged in the third flowline of the first compressor train for controlling hydrocarbon flow from the compressor to the outlet port of the first compressor train.

The present invention also relates to a method of bringing a subsea hydrocarbon flow compression system from a parallel operating mode to a serial operating mode, which compression system is configured to receive a hydrocarbon stream from at least one upstream flowline and supplying the hydrocarbon stream to at least one downstream flowline at an increased pressure, and which compression system comprises first and second compressor trains.

BACKGROUND

In subsea hydrocarbon production and processing systems, there may be a need to "boost" hydrocarbon well-streams, i.e. to increase pressure of the hydrocarbon well-stream, e.g. to compensate for pressure losses in flowlines.

US 2012/118008 A1 shows a method and apparatus for producing a combined gaseous hydrocarbon component stream and liquid hydrocarbon component stream. First and second multi-phase streams are processed in first and second trains that are structurally different from each other such that the first and second trains have different operating conditions. The first and second trains produce first and second gaseous hydrocarbon streams and first and second liquid hydrocarbon component streams. The first and second gaseous hydrocarbon streams are combined downstream of the first and second trains to provide a combined gaseous hydrocarbon component stream.

GB 2503927 A shows as a method and apparatus for removing hydrate plugs in a hydrocarbon production station. The method comprises the steps of fluidically isolating the production station by means of valves, diverting production flow to a bypass line, and adjusting the pressure in the production station to a level sufficient to melt the hydrate plugs by means of a pump/compressor unit and a cooler unit. Hydrate inhibitor such as methanol may be also bled into the system via a line.

FIG. 1 shows a prior art subsea hydrocarbon flow compression system having two compressor trains 10*a*, 10*b* which can operate in parallel or in series.

When operating in parallel, a multiphase well-stream enters a fluid conditioning unit 12*a*, 12*b* of each compressor train 10*a*, 10*b* through one or more flowlines 14. In FIG. 1 the conditioning units 12*a*, 12*b* are liquid/gas separators 12*a*, 12*b*. In the separator 12*a*, 12*b*, gas and liquid, e.g. a condensate/water/MEG, is separated, and gas is led to a subsea compressor 16*a*, 16*b* where it is boosted. The liquid is led to and boosted by a pump 18*a*, 18*b*. Normally the liquid is commingled with the gas downstream of the compressor 16*a*, 16*b* for multiphase transport to a receiving facility (not shown).

The system shown in FIG. 1 is a dry-gas system due to the separators 12*a*, 12*b* being arranged to supply the compressors 16*a*, 16*b* with a fluid stream in which liquid phase components have been removed.

Each compression train 10*a*, 10*b* may have coolers, e.g. an inlet cooler 20*a*, 20*b* arranged upstream of the compressor 16*a*, 16*b* and/or an outlet cooler (not shown) arranged downstream of the compressor 16*a*, 16*b*. An anti-surge cooling functionality may be implemented in the inlet cooler 20*a*, 20*b* and/or in the outlet cooler, and/or in a separate anti-surge cooler (not shown). If an inlet cooler 20*a*, 20*b* is used, this cooler is always located upstream of the separator 12*a*, 12*b* to enhance knock-out of liquid in the separator 12*a*, 12*b*.

The conventional method of switching from parallel to serial operation is to route the gas out of the compressor 16*a* of the first compressor train 10*a* and into the inlet of the second compressor train 10*b*, e.g. by closing valves 22 and 24, and opening valve 26. In this manner, all the equipment in the system will be configured in series. In series configuration, the multiphase well-stream is separated in the first compressor train 10*a* and the liquid and gas phases are commingled prior to entering the second compressor train 10*b*. In the second compressor train 10*b*, the liquid and gas phases are again separated in separator 20*b* and again commingled prior to entering downstream flowline(s) 28.

In this system, the repeated separation and mixing of phases is a result of the arrangement and adds no functional benefits.

While the flow is divided between the separators 12*a*, 12*b* when the compressor trains 10*a*, 10*b* are operating in parallel, the separators 12*a*, 12*b* must be dimensioned for the full well-stream when the compressor trains 10*a*, 10*b* are operating in series. Although hydrocarbon massflow declines over the years prior to series operation (series operation is usually employed during the later production stages), actual volume rates can still be very high because of the declining pressure. In case of slugs or liquid surges, the separator 12*a* of the first compressor train 10*a* must be able to handle the full slug/surge in series operation, while the slugs will be shared between the separators 12*a*, 12*b* in parallel operation.

Normally, pumps have much higher pressure boosting capability than compressors, and series configuration is not required. Consequently, when the system operates in series the separator 12*b* and the pump 18*b* of the second compressor train 10*b* do not provide functional advantages, but instead contribute to critical failure modes for the system.

FIG. 2 shows another prior art subsea compression station having two compressor trains 10*a*, 10*b* which can be switched from operating in parallel to operating in series.

In this case, the compression station incorporates no separators. Instead, in each compressor train 10*a*, 10*b* a conditioning unit 12*a*, 12*b* in the form of a flow-conditioning device is arranged upstream of the compressor 16*a*, 16*b* to condition the liquid/gas mixture such that it complies with the requirements of the compressor 16*a*, 16*b*.

Consequently, the system shown in FIG. 2 is a wet-gas system in which the compressors 16*a*, 16*b* need to boost liquid phase components as well as gas phase components.

Similar to the system shown in FIG. 1, switching from parallel to serial operation mode involves routing the discharge of the first compressor train 10*a* into the inlet of the second compressor train 10*b* by closing valves 22 and 24, and opening valve 26.

In serial operation, the same drawback associated with the separator 12*b* in FIG. 1 is also present for the flow-conditioning device 12*b* in FIG. 2, i.e. that the flow-conditioning device 12*b* does not give any functional advantage in serial operation mode, but only constitutes possible points of failure in the system.

Surface compression plants are normally not arranged as separate trains with dedicated processing equipment incorporated in each train. A typical surface compression plant consists of an upstream processing system providing pre-processed gas to a downstream compression system. Switching from parallel to series is done by re-arranging pipes between the compressors, and the upstream processing system is not affected.

Normally, a surface compression system is made for operating either in parallel or in series, and switching of operating mode from parallel to series is rare. If, however, switching from parallel to series is required, this is done by on-site re-build of the pipe-arrangement of the system. For surface compression system, this can be done at an acceptable cost and usually requires limited production down-time. In subsea applications, however, any on-site re-build of the system will be prohibitively expensive and will also require a non-acceptable production down-time. Hence, a subsea compression system must be designed for all foreseen operation modes with a minimum need of manual intervention.

SUMMARY OF THE INVENTION

With the abovementioned challenges and known solutions in mind, the present invention brings forward a subsea hydrocarbon flow compression system and an associated method which seek to solve or at least reduce at least one of the aforementioned problems or challenges.

According to one aspect, the invention relates to a subsea hydrocarbon flow compression system for receiving a hydrocarbon stream from at least one upstream flowline and supplying the hydrocarbon stream to at least one downstream flowline at an increased pressure, wherein the compression system comprises first and second compressor trains, wherein each compressor train comprises:

- an inlet port which is connectable to the at least one upstream flowline;
- an outlet port which is connectable to the at least one downstream flowline;
- a conditioning unit which is connected to the inlet port via a first flowline; and
- a first flow path for the hydrocarbon fluid comprising a compressor, which compressor is connected to the conditioning unit via a second flowline and to the outlet port via a third flowline, wherein a controllable first valve is arranged in the third flowline of the first compressor train for controlling hydrocarbon flow from the compressor to the outlet port of the first compressor train, and wherein a controllable second valve is arranged in the second flowline of the second compressor train for controlling hydrocarbon flow from the conditioning unit to the compressor of the second compressor train, and wherein the system comprises:

- a first cross-over flowline interconnecting the third flowline of the first compressor train upstream of the first valve and the second flowline of the second compressor train downstream of the second valve, wherein a controllable first cross-over valve is arranged in the first cross-over flowline for controlling hydrocarbon flow through the first cross-over flowline.

Consequently, each compressor train comprises an inlet port, a conditioning unit arranged downstream of the inlet port, a compressor arranged downstream of the conditioning unit, and an outlet port arranged downstream of the compressor. The flow compression system can be operated in a parallel operating mode in which the hydrocarbon flow, in each compressor train, is routed from the inlet port to the outlet port via the conditioning unit and the compressor in respective compressor train. The flow compression system can alternatively be operated in a series operating mode in which the hydrocarbon flow may be routed from the inlet port of the first compressor train to the outlet port of the second compressor train via the conditioning unit and the compressor of the first compressor train and, by virtue of the first cross-over flowline, via the compressor of the second compressor train.

The system may comprise a second cross-over flowline interconnecting the second flowline of the first compressor train and the second flowline of the second compressor train upstream of the second valve, wherein a controllable second cross-over valve may be arranged in the second cross-over flowline for controlling hydrocarbon flow through the second cross-over flowline. This allows the hydrocarbon flow to be routed from the conditioning unit of the first compressor train to the compressor of the second compressor train, or from the conditioning unit of the second compressor train to the compressor of the first compressor train.

The system may comprise a third cross-over flowline interconnecting the third flowline of the first compressor train downstream of the first valve and the third flowline of the second compressor train, wherein a controllable third cross-over valve may be arranged in the third cross-over flowline for controlling hydrocarbon flow through the third cross-over flowline.

At least one of said first and second compressor trains may comprise an inlet cooler arranged downstream of the conditioning unit and upstream of the compressor.

The second compressor train may comprise an inlet cooler arranged downstream of the conditioning unit and upstream of the compressor, wherein the inlet cooler of the second compressor train may be arranged downstream of said second valve, and wherein said first cross-over flowline may be connected to said second flowline of the second compressor train upstream of the inlet cooler.

At least one of said first and second compressor trains may comprise at least one of:

- an outlet cooler arranged downstream of the compressor; and
- an anti-surge cooler arranged in an anti-surge feed-back loop of the compressor.

An anti-surge cooling functionality may be embedded in any one of the inlet cooler and the outlet cooler.

Each compressor train may comprise:

- a second flow path for the hydrocarbon fluid arranged in parallel to said first flow path, which second flow path may comprise a pump which is connected to the conditioning unit via a fourth flowline and to the outlet port via a fifth flowline, wherein said conditioning unit may comprise a separator for separating a multiphase hydrocarbon stream received by the conditioning unit into a first sub-stream comprising predominately a gaseous fluid phase and a second sub-stream comprising predominately a liquid fluid phase, wherein said first flow path may be configured to receive the first sub-stream from the conditioning unit, and the second flow path may be configured to receive the second sub-stream from the conditioning unit, wherein a controllable third valve may be arranged in the fifth flowline of the first compressor train for controlling hydrocarbon flow from the pump to the outlet port of the first compressor train, and wherein the system may comprise:

a fourth cross-over flowline interconnecting the fifth flowline of the first compressor train upstream of the third valve and the third flowline of the second compressor train, wherein a controllable fourth cross-over valve may be arranged in the fourth cross-over flowline for controlling hydrocarbon flow through the fourth cross-over flowline.

The system may comprise a fifth cross-over flowline interconnecting the fourth flowline of the first compressor train and the fourth flowline of the second compressor train, wherein a controllable fifth cross-over valve may be arranged in the fifth cross-over flowline for controlling hydrocarbon flow through the fifth cross-over flowline. Also, a pump isolation valve may be arranged immediately upstream of each pump. This will allow the liquid fraction of the fluid emerging from the separator of the conditioning unit of the first compressor train to be led to pump of the second compressor train, and the fluid emerging from the separator of the conditioning unit of the second compressor train to be led to the pump of the first compressor train, thus allowing the pump of the first compressor train or the pump of the second compressor train to be disconnected from the fluid path and thus isolated from fluid flow.

Said inlet port of the first compressor train and said inlet port of the second compressor train may form a common inlet port and/or said outlet port of the first compressor train and said outlet port of the second compressor train may form a common outlet port.

Said conditioning unit of each compressor train may be any one of:

a separator for separating a multiphase hydrocarbon stream into a first sub-stream comprising predominately a gaseous fluid phase and a second sub-stream comprising predominately a liquid fluid phase; and a flow-conditioning device for conditioning the liquid/gas ratio of the fluid such that it complies with the requirements of the compressor.

The compression system may have two, three, four or more compressor trains, of which at least two compressor trains are interconnected according to the invention to allow switching between said parallel operating mode and said serial operating mode.

According to another aspect, the invention relates a method of bringing a subsea hydrocarbon flow compression system from a parallel operating mode to a serial operating mode, which compression system is configured to receive a hydrocarbon stream from at least one upstream flowline and supply the hydrocarbon stream to at least one downstream flowline at an increased pressure, and which compression system comprises first and second compressor trains, wherein each compressor train comprises:

a conditioning unit which, in said parallel operating mode, receives hydrocarbon fluid from an inlet port connected to the at least one upstream flowline; and a first flow path for the hydrocarbon fluid comprising a compressor which, in said parallel operating mode, receives hydrocarbon fluid from the conditioning unit and supplies hydrocarbon fluid to an outlet port connected to the at least one downstream flowline;

wherein the method comprises the steps of:

closing a conduit path for the hydrocarbon fluid from the compressor to the outlet port of the first compressor train;

closing a conduit path for the hydrocarbon fluid from the conditioning unit to the compressor of the second compressor train; and opening a conduit path for the hydrocarbon fluid from the compressor of the first compressor train to the compressor of the second compressor train.

This will allow hydrocarbon fluid to be supplied to the compressor of the first compressor train from the conditioning unit of the first compressor train but not from the conditioning unit of the second compressor train.

The method may comprise the step of opening a conduit path for the hydrocarbon fluid from the conditioning unit of the second compressor train to the compressor of the first compressor train, thus allowing, in the serial operating mode, the conditioning units of the first and second compressor trains to supply hydrocarbon fluid to the compressor of the first compressor train in parallel.

The method may comprise the steps of:

opening a conduit path for the hydrocarbon fluid from the conditioning unit of the second compressor train to the compressor of the first compressor train; and closing a conduit path for the hydrocarbon fluid from the conditioning unit of the first compressor train to the compressor of the first compressor train, thus allowing, in the serial operating mode, hydrocarbon fluid to be supplied to the compressor of the first compressor train from the conditioning unit of the second compressor train but not from the conditioning unit of the first compressor train (110*a*)

The method may comprise the step of opening a conduit path for the hydrocarbon fluid from the compressor of the second compressor train to the outlet port of the first compressor train.

The method may comprise the step of, in at least one of said compressor trains, routing the hydrocarbon fluid through an inlet cooler arranged downstream of the conditioning unit and upstream of the compressor.

The method may comprise the step of, in the second compressor train, routing the hydrocarbon fluid through an inlet cooler arranged downstream of the conditioning unit and upstream of the compressor in the second compressor train, wherein the inlet cooler of the second compressor train may be arranged downstream of said second valve, and wherein said first cross-over flowline may be connected to said second flowline of the second compressor train upstream of the inlet cooler.

The method may comprise the step of, in at least one of said compressor trains, routing the hydrocarbon fluid through at least one of:

an outlet cooler arranged downstream of the compressor; and an anti-surge cooler arranged in an anti-surge feed-back loop of the compressor.

Each compressor train may comprise a second flow path comprising a pump which, in said parallel operating mode, receives hydrocarbon fluid from the conditioning unit and supplies hydrocarbon fluid to the outlet port, wherein the conditioning unit separates an incoming multiphase hydrocarbon fluid into a first sub-stream comprising predominately a gaseous fluid phase and a second sub-stream comprising predominately a liquid fluid phase, which first sub-stream is routed to the outlet port via the first flow path, and which second sub-stream is routed to the outlet port via the second flow path, wherein said method may comprise the steps of:

closing a conduit path for the hydrocarbon fluid from the pump to the outlet port in the first compressor train; and opening a conduit path for the hydrocarbon fluid from the pump of the first compressor train to the outlet port of the second compressor train.

The method may comprise the step of:

closing a conduit path for the hydrocarbon fluid from the conditioning unit of the first compressor train to the pump of the first compressor train; and opening a conduit path for the hydrocarbon fluid from the conditioning unit of the first compressor train to the pump of the second compressor train.

This will allow the pump of the first compressor train to be isolated from fluid flow.

Alternatively, the method may comprise the step of:

closing a conduit path for the hydrocarbon fluid from the conditioning unit of the second compressor train to the pump of the second compressor train; and opening a conduit path for the hydrocarbon fluid from the conditioning unit of the second compressor train to the pump of the first compressor train.

This will allow the pump of the second compressor train to be isolated from fluid flow.

According to one aspect, the invention lies in how the crossover between the compressor trains is implemented when the subsea hydrocarbon flow compression system is switched from parallel to serial operation mode.

When in parallel operation mode, the subsea hydrocarbon flow compression system according to the invention generally operates in the same way as prior art systems.

However, when in serial operation mode, the implementation of the cross-over will enable the compressors (and their anti-surge loops, if present) to operate in series, while allowing the conditioning units and pumps (if present) to continue to operate in parallel.

Also, in some embodiments of the invention, the implementation of the cross-over will allow superfluous conditioning units and/or pump(s) (if present) to be isolated when the system is in serial operating mode (by isolation valves normally provided for each main component), and to serve as installed spares.

This brings about a number of benefits:

1. The size and/or rating of the conditioning units and/or pumps can be reduced because the flow and liquid slugs or surges can be shared between multiple conditioning units and/or pumps working in parallel (although the compressors operate in series). Alternatively, in cases when a conditioning unit and/or pump is not required in serial operating mode (e.g. due to reduced late life demand), such a unit can be isolated to serve as an installed spare.
2. It allows conditioning units and/or pumps that are not functionally required during serial operating mode to be isolated from the serial flow path of the hydrocarbon fluid, thus avoiding equipment in the flow path which are not functionally required and which could cause loss of production in case of failure.
3. In systems that incorporate pumps it is possible to maintain, in serial operating mode, multiple parallel liquid streams through the system and enable flexible routing of liquid to the downstream flowlines, keeping control on flow-assurance issues (e.g. MEG inhibition of flowlines).

Said compressors may be any type compressor suitable to boost, i.e. to compress and increase pressure of, a hydrocarbon fluid. Such compressors are known in the art and the details of which will not be discussed at any depth here.

Said pumps may be any type pump suitable to boost, i.e. increase the pressure of, a hydrocarbon fluid. Such pumps are known in the art and the details of which will not be discussed at any depth here.

Said conditioning units may be any one of a liquid/gas separator for separating a gas fraction and a liquid fraction from an incoming hydrocarbon fluid, and a flow conditioning device (FCD) configured to condition an incoming liquid/gas mixture of the hydrocarbon fluid such that it complies with the requirements of a downstream compressor. Such conditioning units are known in the art and the details of which will not be discussed at any depth here.

Said coolers may be any type suitable to cool a hydrocarbon stream. Such cooler are known in the art and the details of which will not be discussed at any depth here.

Above-discussed preferred and/or optional features of each aspect of the invention may be used, alone or in appropriate combination, in the other aspects of the invention.

In the following, one or more specific embodiments of the invention will be described in more detail with reference to the drawings.

DESCRIPTION OF THE DRAWINGS

Following drawings are appended to facilitate the understanding of the invention.

Figure 1:
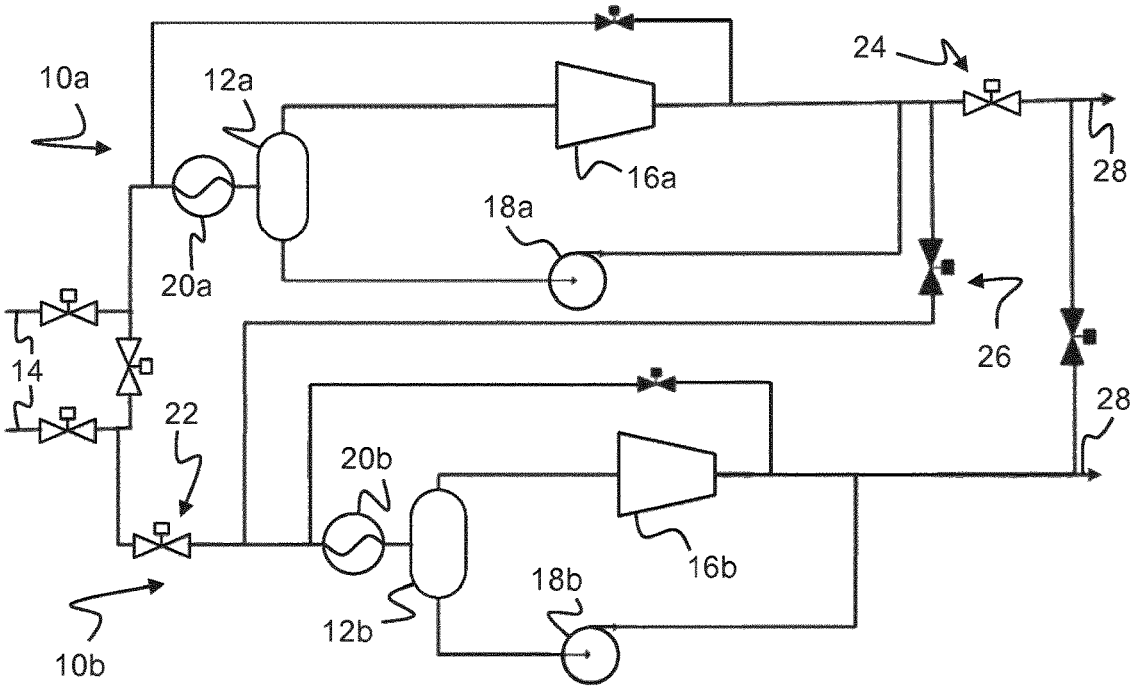
Fig. 1 (Prior Art)
FIG. 1 shows a prior art dry-gas subsea hydrocarbon flow compression system.
Figure 2:
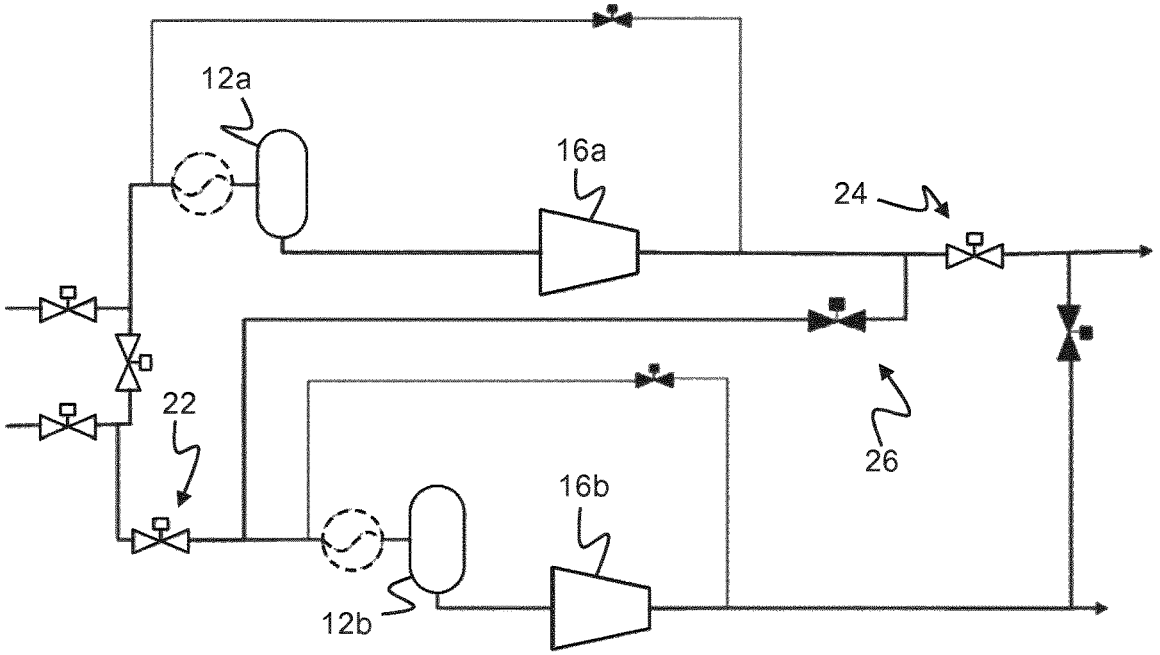
Fig. 2 (Prior Art)
FIG. 2 shows a prior art wet-gas subsea hydrocarbon flow compression system.

It should be understood, however, that the drawings are not intended to limit the invention to the subject-matter depicted in the drawings.

In the drawings, like reference numerals have been used to indicate common parts, elements or features unless otherwise explicitly stated or implicitly understood by the context.

DETAILED DESCRIPTION OF THE INVENTION

Figure 3:
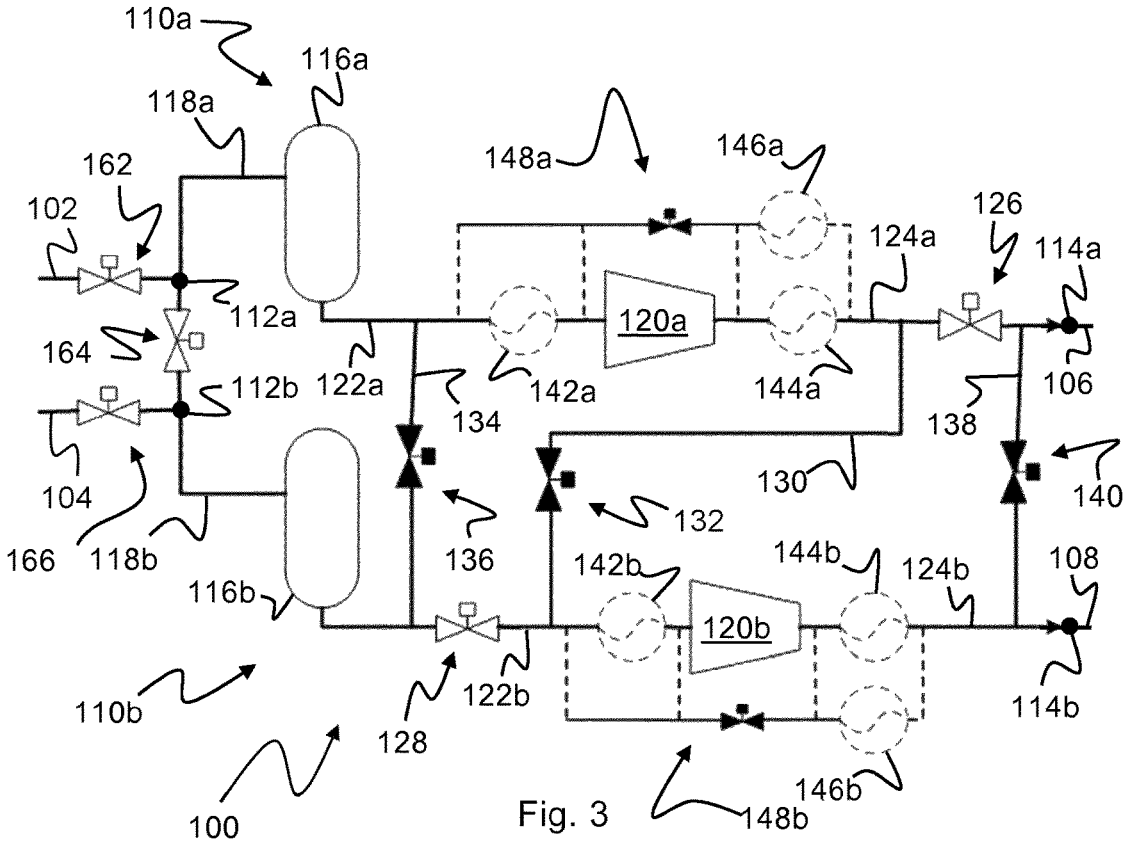
FIG. 3 shows an embodiment of a wet-gas subsea hydrocarbon flow compression system according to the invention.

FIG. 3 shows an embodiment of a hydrocarbon flow compression system 100 according to the invention. The system 100 receives a hydrocarbon fluid stream from upstream flowlines 102, 104 and supplies the hydrocarbon fluid stream to downstream flowlines 106, 108 at an increased pressure.

The system 100 comprises a first compressor train 110*a* and a second compressor train 110*b*. Each compressor train 110*a*, 110*b* comprises an inlet port 112*a*, 112*b* which is connected to the upstream flowlines 102, 104 for receiving the hydrocarbon fluid from the same. Each compressor train 110*a*, 110*b* also comprises an outlet port 114*a*, 114*b* which is connected to the downstream flowlines 106, 108 for supplying the hydrocarbon fluid to the same. Each compressor train 110*a*, 110*b* further comprises a fluid conditioning unit 116*a*, 116*b* which is connected to the inlet port 112*a*, 112*b* via a first flowline 118*a*, 118*b*, and a compressor 120*a*, 120*b* which is connected to the fluid conditioning unit 116*a*, 116*b* via a second flowline 122*a*, 122*b* and to the outlet port 114*a*, 114*b* via a third flowline 124*a*, 124*b*.

Consequently, the first flow line 118*a*, 118*b*, the fluid conditioning unit 116*a*, 116*b*, the second flowline 122*a*, 122*b*, the compressor 120*a*, 120*b* and the third flowline 124*a*, 124*b* provide a flow path for the hydrocarbon fluid through each compressor train 110*a*, 110*b*.

Each fluid conditioning unit 116*a*, 116*b* comprises a flow conditioning device (FCD) which is configured to condition the liquid/gas mixture of the hydrocarbon fluid such that it complies with the requirements of the compressor 116*a*, 116*b*. FCD:s are known as such and will not be described further here. For the purpose of the invention, any prior art FCD can be used in the system shown in FIG. 3 to condition the hydrocarbon fluid such that it complies with the requirements of the compressor 116*a*, 116*b*.

Inlet valves 162, 164, 166 are arranged upstream of the inlet ports 112*a*, 112*b* to control routing of the hydrocarbon fluid from the upstream flowlines 102, 104 into the different compressor trains 110*a*, 110*b*. Inlet valve 164 can alternatively be substituted with a small-bore pipe for equalize pressure between the inlet ports 112*a* and 112*b*. Also, outlet valves (not shown) may be arranged downstream of the outlet ports 114*a*, 114*b* to control routing of the hydrocarbon fluid from the outlet ports 114*a*, 114*b* to the downstream flowlines 106, 108.

A controllable first valve 126 is arranged in the third flowline 124*a* of the first compressor train 110*a* for controlling hydrocarbon fluid flow from the compressor 120*a* to the outlet port 114*a*. Also, a controllable second valve 128 is arranged in the second flowline 122*b* of the second compressor train 110*b* for controlling hydrocarbon flow from the conditioning unit 116*b* to the compressor 120*b*.

Furthermore, a first cross-over flowline 130 interconnecting the third flowline 124*a* of the first compressor train 110*a* upstream of the first valve 126 and the second flowline 122*b* of the second compressor train 110*b* downstream of the second valve 128, and a controllable first cross-over valve 132 is arranged in the first cross-over flowline 130 for controlling hydrocarbon fluid flow through the first cross-over flowline 130.

When the system 100 operates in parallel mode, the first cross-over valve 132 is closed and valves 126 and 128 are open. Consequently, in this operating mode there are two parallel flow paths for the hydrocarbon fluid, i.e. the flow path created through each compressor train 110*a*, 110*b* by the first flow line 118*a*, 118*b*, the fluid conditioning unit 116*a*, 116*b*, the second flowline 122*a*, 122*b*, the compressor 120*a*, 120*b* and the third flowline 124*a*, 124*b*.

When switching from parallel to serial operation mode, the first valve 126 is closed, thus closing the conduit path for the hydrocarbon fluid from the compressor 120*a* to the outlet port 114*a* in the first compressor train 110*a*. Also, the second valve 128 is closed, thus closing the conduit path for the hydrocarbon fluid from the conditioning unit 116*b* to the compressor 120*b* in the second compressor train 110*b*. Furthermore, the first cross-over valve 132 is opened, thus opening a conduit path for the hydrocarbon fluid from the compressor 120*a* of the first compressor train 110*a* to the compressor 120*b* of the second compressor train 110*b*.

Consequently, when switching from parallel to serial operating mode, a conduit path for the hydrocarbon fluid is created through the conditioning unit 116*a* and the compressor 120*a* of the first compressor train 110*a*, and through the compressor 120*b* of the second compressor train 110*b* without routing the hydrocarbon fluid through the conditioning unit 116*b* of the second compressor train 110*b*.

The system 100 may comprise a second cross-over flowline 134 interconnecting the second flowline 122*a* of the first compressor train 110*a* and the second flowline 122*b* of the second compressor train 110*b* upstream of the second valve 128, and a controllable second cross-over valve 136 may be arranged in the second cross-over flowline 134 for controlling hydrocarbon flow through the second cross-over flowline 134. This will allow the conditioning units 116*a*, 116*b* of the first and second compressor trains 110*a*, 110*b* to be operated in parallel also when the system 100 is otherwise operating in serial operating mode, i.e. with the compressors 120*a* and 120*b* operating in series (due to valves 126 and 128 being closed and valve 132 being open). In other words, when the second cross-over valve 136 is open, there will be a parallel fluid path for the hydrocarbon fluid through the conditioning units 116*a* and 116*b* to the compressor 120*a*, and thereafter a serial fluid path through the compressors 120*a*, 120*b*, thus allowing, in the serial operating mode, the conditioning units 116*a*, 116*b* of the first and second compressor trains 110*a*, 110*b* to supply hydrocarbon fluid to the compressor 120*a* of the first compressor train 110*a* in parallel.

Alternatively, the system may comprise valves (not show) that allow the conditioning unit 116*a* of the first compressor train 110*a* to be isolated from the inlet ports 12*a*, 112*b*, thus allowing the system, in serial operating mode, to be operated with both conditioning units 116*a* and 116*b* in parallel or with only one of the conditioning units 116*a*, 116*b* supplying fluid to the compressors 120*a*, 120*b*. This will allow any one of the conditioning units 116*a*, 116*b* to be disconnected from the fluid path when the system is operated in serial operating mode.

The system 100 may comprise a third cross-over flowline 138 interconnecting the third flowline 124*a* of the first compressor train 110*a* downstream of the first valve 126 and the third flowline 124*b* of the second compressor train 110*b*, and a controllable third cross-over valve 140 may be arranged in the third cross-over flowline 138 for controlling hydrocarbon flow through the same. This allows a conduit path for the hydrocarbon fluid to be opened from the compressor 120*b* of the second compressor train 110*b* to the outlet port 114*a* of the first compressor train 110*a*, thus allowing fluid to be routed to the outlet port 114*a* of the first compressor train 110*a* also when the system 100 is operating in the serial operation mode, i.e. when valve 126 is closed.

At least one of said first and second compressor trains 110*a*, 110*b* may comprises an inlet cooler 142*a*, 142*b* arranged downstream of the conditioning unit 116*a*, 116*b* and upstream of the compressor 120*a*, 120*b*.

If the second compressor train 110*b* comprises an inlet cooler 142*b* arranged downstream of the conditioning unit 116*b* and upstream of the compressor 120*b*, then the inlet cooler 142*b* of the second compressor train 110*b* is advantageously arranged downstream of said second valve 128, and said first cross-over flowline 130 is advantageously connected to said second flowline 122*b* of the second compressor train 110*b* upstream of the inlet cooler 142*b*. In this way, the inlet cooler 142*b* will be in the fluid path of the hydrocarbon fluid also when the system 100 is operated in the serial operation mode. However, the first cross-over flowline 130 may alternatively be connected to the second flowline 122*b* downstream of the inlet cooler 142*b*, in which case the inlet cooler 142*b* will be in the fluid path of the hydrocarbon fluid only when the system 100 is operated in parallel operation mode.

In addition to arranging inlet coolers 142*a*, 142*b* in at least one of said first and second compressor trains 110*a*, 110*b*, or as an alternative thereto, at least one of said first and second compressor trains 110*a*, 110*b* may comprise at least one of an outlet cooler 144*a*, 144*b* arranged downstream of the compressor 120*a*, 120*b*; and an anti-surge cooler 146*a*, 146*b* arranged in an anti-surge feed-back loop 148*a*, 148*b* of the respective compressor 120*a*, 120*b*.

Figure 4:
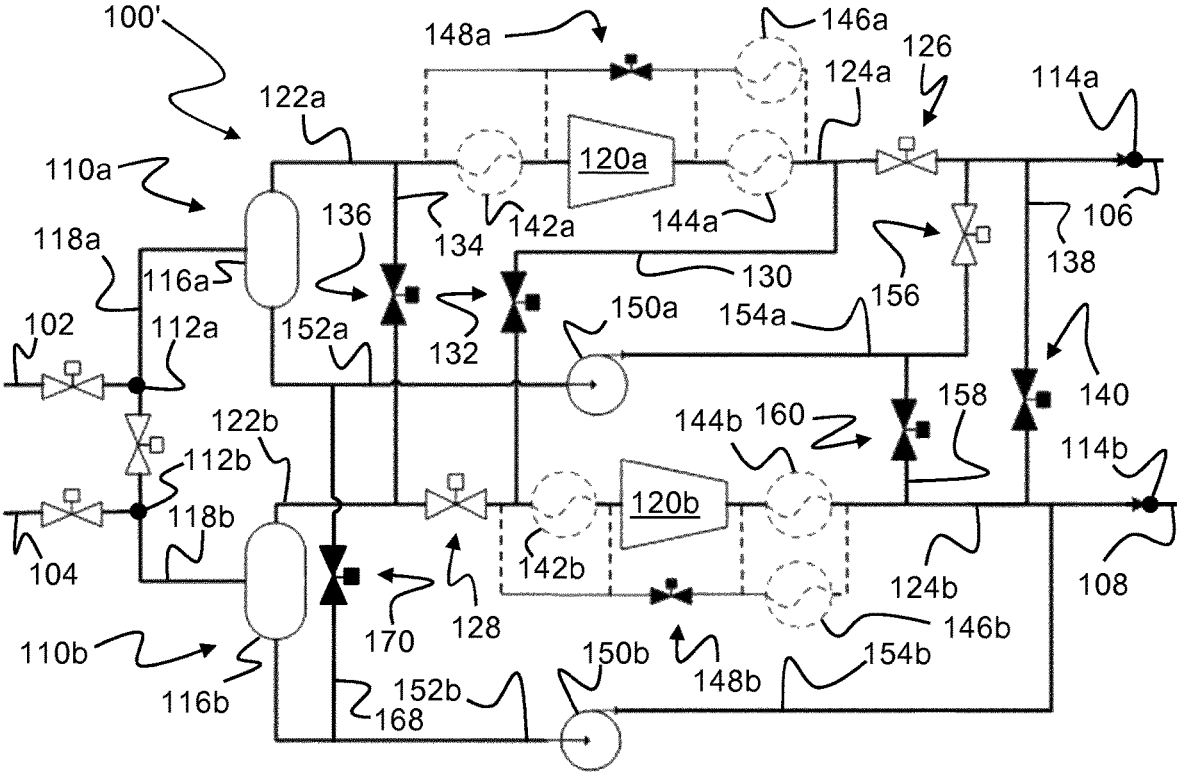
FIG. 4 shows an embodiment of a dry-gas subsea hydrocarbon flow compression system according to the invention.

FIG. 4 shows an embodiment of a dry-gas hydrocarbon flow compression system 100' according to the invention. The system 100' comprises the same features as previously discussed with reference to FIG. 3 and like reference numerals have been used to indicate common parts, elements or features unless otherwise stated.

However, the system 100' of FIG. 4 differs from the system 100 of FIG. 3 in that each compressor train 110*a*, 110*b* comprises a second flow path for the hydrocarbon fluid arranged in parallel to said first flow path, which second flow path comprises a pump 150*a*, 150*b* which is connected to the conditioning unit 116*a*, 116*b* via a fourth flowline 152*a*, 152*b* and to the outlet port 114*a*, 114*b* via a fifth flowline 154*a*, 154*b*. Also, in this embodiment the conditioning unit 116*a*, 116*b* in each compressor train 110*a*, 110*b* comprises a separator for separating a multiphase hydrocarbon stream received by the conditioning unit 116*a*, 116*b* into a first sub-stream comprising predominately a gaseous fluid phase and a second sub-stream comprising predominately a liquid fluid phase. The first flow path, i.e. comprising the compressor 120*a*, 120*b*, is configured to receive the first, gaseous sub-stream from the conditioning unit 116*a*, 116*b*, and the second flow path, i.e. comprising the pump 150*a*, 150*b*, is configured to receive the second, liquid sub-stream from the conditioning unit 116*a*, 116*b*. Consequently, the system 100' is a dry-gas hydrocarbon flow compression system.

Also, a controllable third valve 156 is arranged in the fifth flowline 154*a* of the first compressor train 110*a* for controlling hydrocarbon flow from the pump 150*a* to the outlet port 114*a* of the first compressor train 110*a*. Furthermore, the system 100' comprises a fourth cross-over flowline 158 interconnecting the fifth flowline 154*a* of the first compressor train 110*a* upstream of the third valve 156 and the third flowline 124*b* of the second compressor train 110*b*, wherein a controllable fourth cross-over valve 160 is arranged in the fourth cross-over flowline 158 for controlling hydrocarbon flow through the fourth cross-over flowline 158.

When operating in parallel mode, cross-over valves 132, 136, 140 and 160 are closed and valves 126, 128 and 156 are open, thus allowing hydrocarbon fluid to flow from the upstream flowlines 102, 104 to the downstream flowlines 106, 108 in parallel in the first and second compressor trains 110*a* and 110*b*, wherein, in each compressor train 110*a*, 110*b*, the gaseous fraction of the hydrocarbon fluid is boosted in the compressor 120*a*, 120*b* and the liquid fraction is boosted in the pump 150*a*, 150*b*.

When switching from parallel to serial operational mode, the first and second valves 126, 128 are closed, and the first and second cross-over valves 132, 136 are opened. This will close the conduit paths for the hydrocarbon fluid from the compressor 120*a* to the outlet port 114*a* in the first compressor train 110*a* and from the conditioning unit 116*b* to the compressor 120*b* in the second compressor train 110*b*, and open conduit paths from the compressor 120*a* of the first compressor train 110*a* to the compressor 120*b* of the second compressor train 110*b* and from the conditioning unit 116*b* of the second compressor train 110*b* to the compressor 120*a* of the first compressor train 110*a*.

The positions (open or closed) of the third valve 156 and the fourth cross-over valve 160 will decide which of the downstream flowlines 106, 108 will receive the liquid from the pump 150*a* in the first compressor train 110*a*, and the position of the third cross-over valve 140 will decide whether the gas output from the system will be disposed in a single flowline 114*b* or if the gas will be shared between flowlines 114*a* and 114*b*.

The system 100' may comprise a fifth cross-over flowline 168 interconnecting flowlines 152*a* and 152*b*, wherein a controllable fifth cross-over valve 170 may be arranged in the fifth cross-over flowline for controlling hydrocarbon flow through the same. Also, a pump isolation valve (not shown) may be arranged immediately upstream of each pump 150*a* and 150*b*. This will allow the liquid fraction of the fluid emerging from the separator of conditioning unit 116*a* to be led to pump 150*b*, and the fluid emerging from the separator of conditioning unit 116*b* to be led to pump 150*a*, thus allowing anyone of pumps 150*a* and 150*b* to be disconnected from the fluid path.

In the same way as the system 100 discussed with reference to FIG. 3, at least one of said first and second compressor trains 110*a*, 110*b* may comprises an inlet cooler 142*a*, 142*b* arranged downstream of the conditioning unit 116*a*, 116*b* and upstream of the compressor 120*a*, 120*b*.

However, if the system 100' comprises such an inlet cooler 142*a*, 142*b*, some liquid may condense in the cooler 142*a*, 142*b* and enter the compressor 120*a*, 120*b*. Consequently, for such an arrangement the compressor 120*a*, 120*b* should preferably be tolerant of liquid, i.e. be able to handle that at least some liquid is present in the incoming fluid stream.

In addition or as an alternative to said inlet coolers 142*a*, 142*b*, at least one of said first and second compressor trains 110*a*, 110*b* may comprise at least one of an outlet cooler 144*a*, 144*b* arranged downstream of the compressor 120*a*, 120*b*; and an anti-surge cooler 146*a*, 146*b* arranged in an anti-surge feed-back loop 148*a*, 148*b* of the respective compressor 120*a*, 120*b*.

In serial operation mode, some liquid may condense in the outlet cooler 144*a* of the first compressor train 110*a* (if present) and/or in the inlet cooler 142*b* of the second compressor trains 110*b* (if present). Consequently, in such an arrangement the compressor 120*b* of the second compressors train 110*b* should preferably be tolerant of liquid, i.e. be able to handle that at least some liquid is present in the incoming fluid stream.

In the preceding description, various aspects of the system and method according to the invention have been described with reference to the illustrative embodiments. For purposes of explanation, specific numbers, systems and configurations were set forth in order to provide a thorough understanding of the system and its workings. However, this description is not intended to be construed in a limiting sense. Various modifications and variations of the illustrative embodiment, as well as other embodiments of the system and method, which are apparent to person skilled in the art to which the disclosed subject-matter pertains, are deemed to lie within the scope of the present invention as defined by the following claims.

The invention claimed is:

1. A subsea hydrocarbon flow compression system for receiving a hydrocarbon stream from at least one upstream flowline and supplying the hydrocarbon stream to at least one downstream flowline at an increased pressure, wherein the compression system comprises:

first and second compressor trains, each of which comprises:

an inlet port which is connectable to the at least one upstream flowline;

an outlet port which is connectable to the at least one downstream flowline;

a conditioning unit which is connected to the inlet port via a first flowline; and a first flow path for the hydrocarbon fluid, the first flow path comprising a compressor which is connected to the conditioning unit via a second flowline and to the outlet port via a third flowline;

a controllable first valve which is arranged in the third flowline of the first compressor train for controlling hydrocarbon flow from the compressor of the first compressor train to the outlet port of the first compressor train;

a controllable second valve which is arranged in the second flowline of the second compressor train for controlling hydrocarbon flow from the conditioning unit of the second compressor train to the compressor of the second compressor train;

a first cross-over flowline interconnecting the third flowline of the first compressor train upstream of the controllable first valve and the second flowline of the second compressor train downstream of the controllable second valve; and a controllable first cross-over valve which is arranged in the first cross-over flowline for controlling hydrocarbon flow through the first cross-over flowline.

2. The system according to claim 1, further comprising:

a second cross-over flowline interconnecting the second flowline of the first compressor train and the second flowline of the second compressor train upstream of the second valve; and a controllable second cross-over valve which is arranged in the second cross-over flowline for controlling hydrocarbon flow through the second cross-over flowline.

3. The system according to claim 1, wherein at least one of said first and second compressor trains comprises an inlet cooler arranged downstream of the conditioning unit and upstream of the compressor.

4. The system according to claim 3, wherein the second compressor train comprises an inlet cooler arranged downstream of the conditioning unit and upstream of the compressor, wherein the inlet cooler of the second compressor train is arranged downstream of said second valve, and wherein said first cross-over flowline is connected to said second flowline of the second compressor train upstream of the inlet cooler.

5. The system according to claim 1, wherein each compressor train further comprises:

a second flow path for the hydrocarbon fluid arranged in parallel to said first flow path, the second flow path comprising a pump which is connected to the conditioning unit via a fourth flowline and to the outlet port via a fifth flowline;

wherein each conditioning unit comprises a multiphase separator for separating a multiphase hydrocarbon stream received by the conditioning unit into a first sub-stream comprising predominately a gaseous fluid phase and a second sub-stream comprising predominately a liquid fluid phase;

wherein said first flow path is configured to receive the first sub-stream from the conditioning unit and the second flow path is configured to receive the second sub-stream from the conditioning unit; and wherein the system further comprises:

a controllable third valve which is arranged in the fifth flowline of the first compressor train for controlling hydrocarbon flow from the pump of the first compressor train to the outlet port of the first compressor train;

a fourth cross-over flowline interconnecting the fifth flowline of the first compressor train upstream of the controllable third valve and the third flowline of the second compressor train; and a controllable fourth cross-over valve which is arranged in the fourth cross-over flowline for controlling hydrocarbon flow through the fourth cross-over flowline.

6. The system according to claim 5, further comprising:

a fifth cross-over flowline interconnecting the fourth flowline of the first compressor train and the fourth flowline of the second compressor train; and a controllable fifth cross-over valve which is arranged in the fifth cross-over flowline for controlling hydrocarbon flow through the fifth cross-over flowline.

7. A method of bringing a subsea hydrocarbon flow compression system from a parallel operating mode to a serial operating mode, the compression system being configured to receive a hydrocarbon stream from at least one upstream flowline and supply the hydrocarbon stream to at least one downstream flowline at an increased pressure, and the compression system comprising:

first and second compressor trains, each of which comprises:

a conditioning unit which, in said parallel operating mode, receives hydrocarbon fluid from an inlet port connected to the at least one upstream flowline; and a first flow path for the hydrocarbon fluid, the first flow path comprising a compressor which, in said parallel operating mode, receives hydrocarbon fluid from the conditioning unit and supplies hydrocarbon fluid to an outlet port connected to the at least one downstream flowline;

wherein the method comprises the steps of:

closing a first conduit path for the hydrocarbon fluid from the compressor of the first compressor train to the outlet port of the first compressor train;

closing a second conduit path for the hydrocarbon fluid from the conditioning unit of the second compressor train to the compressor of the second compressor train; and opening a cross-over conduit path for the hydrocarbon fluid from the compressor of the first compressor train to the compressor of the second compressor train.

8. The method according to claim 7, wherein hydrocarbon fluid is supplied to the compressor of the first compressor train from the conditioning unit of the first compressor train but not from the conditioning unit of the second compressor train.

9. The method according to claim 7, further comprising the step of opening a conduit path for the hydrocarbon fluid from the conditioning unit of the second compressor train to the compressor of the first compressor train, thus allowing, in the serial operating mode, the conditioning units of the first and second compressor trains to supply hydrocarbon fluid to the compressor of the first compressor train in parallel.

10. The method according to claim 7, further comprising the steps of:

opening a conduit path for the hydrocarbon fluid from the conditioning unit of the second compressor train to the compressor of the first compressor train; and closing a conduit path for the hydrocarbon fluid from the conditioning unit of the first compressor train to the compressor of the first compressor train;

thus allowing, in the serial operating mode, hydrocarbon fluid to be supplied to the compressor of the first compressor train from the conditioning unit of the second compressor train but not from the conditioning unit of the first compressor train.

11. The method according to claim 7, further comprising the step of, in at least one of said compressor trains, routing the hydrocarbon fluid through an inlet cooler arranged downstream of the conditioning unit and upstream of the compressor.

12. The method according to claim 7, further comprising the step of, in the second compressor train, routing the hydrocarbon fluid through an inlet cooler arranged downstream of the conditioning unit and upstream of the compressor in the second compressor train, wherein the step of closing the second conduit path is performed using a valve in the second conduit path, wherein the inlet cooler of the second compressor train is arranged downstream of said valve, and wherein said cross-over conduit path is connected to said second conduit path of the second compressor train upstream of the inlet cooler.

13. The method according to claim 7, wherein each compressor train comprises a second flow path comprising a pump which, in said parallel operating mode, receives hydrocarbon fluid from the conditioning unit and supplies hydrocarbon fluid to the outlet port, wherein the conditioning unit separates an incoming multiphase hydrocarbon fluid into a first sub-stream comprising predominately a gaseous fluid phase and a second sub-stream comprising predominately a liquid fluid phase, wherein the first sub-stream is routed to the outlet port via the first flow path and the second sub-stream is routed to the outlet port via the second flow path, and wherein the method further comprises the steps of:

closing a conduit path for the hydrocarbon fluid from the pump of the first compressor train to the outlet port of the first compressor train; and opening a conduit path for the hydrocarbon fluid from the pump of the first compressor train to the outlet port of the second compressor train.

14. The method according to claim 13, further comprising the steps of:

closing a conduit path for the hydrocarbon fluid from the conditioning unit of the first compressor train to the pump of the first compressor train; and opening a conduit path for the hydrocarbon fluid from the conditioning unit of the first compressor train to the pump of the second compressor train.

15. The method according to claim 13, further comprising the steps of:

closing a conduit path for the hydrocarbon fluid from the conditioning unit of the second compressor train to the pump of the second compressor train; and opening a conduit path for the hydrocarbon fluid from the conditioning unit of the second compressor train to the pump of the first compressor train.

* * * * *